US010865528B2

(12) United States Patent
Bevill et al.

(10) Patent No.: US 10,865,528 B2
(45) Date of Patent: Dec. 15, 2020

(54) SIDE CUTTER FOR MILLING MACHINE

(71) Applicant: Roadtec, Inc., Chattanooga, TN (US)

(72) Inventors: James H. Bevill, Lookout Mountain, GA (US); Tim Stevens, Harrison, TN (US)

(73) Assignee: Roadtec, Inc., Chattanooga, TN (US)

( * ) Notice: Subject to any disclaimer, the term of this patent is extended or adjusted under 35 U.S.C. 154(b) by 0 days.

(21) Appl. No.: 16/561,211

(22) Filed: Sep. 5, 2019

(65) Prior Publication Data

US 2020/0080267 A1 Mar. 12, 2020

Related U.S. Application Data

(60) Provisional application No. 62/727,761, filed on Sep. 6, 2018.

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/12; E01C 23/09
USPC ..... 404/90–94; 299/39.1–39.5
See application file for complete search history.

(56) References Cited

U.S. PATENT DOCUMENTS 5,315,770 A * 5/1994 Campbell ..... E02F 3/188 37/190
2014/0270956 A1* 9/2014 Seovic ..... E01C 23/088 404/93
2017/0174422 A1* 6/2017 Schomaker ..... B60P 1/54

FOREIGN PATENT DOCUMENTS

EP 0875624 A2 * 11/1998

* cited by examiner

*Primary Examiner* — Sunil Singh
(74) *Attorney, Agent, or Firm* — Chambliss, Bahner & Stophel, P.C.

(57) ABSTRACT

A side cutter milling assembly is used to modify a milling machine having a frame, a milling drum housing that is removably attached to the frame, a milling drum that is mounted for rotation within the milling drum housing, and a primary drum drive assembly that is adapted to rotate the milling drum. The side cutter milling assembly includes a drum housing having a main portion and a side portion. The main portion is adapted to be installed on the frame of the milling machine in place of the milling drum housing, and the side portion is offset to one side of the milling machine. A side cutter milling drum is mounted for rotation within the side portion of the drum housing, and a side cutter drivetrain is configured and adapted to be operatively attached to the side cutter milling drum and the primary drum drive assembly.

8 Claims, 7 Drawing Sheets

SIDE CUTTER FOR MILLING MACHINE

CROSS-REFERENCE TO RELATED APPLICATION

This application claims the benefit of U.S. Provisional Patent Application No. 62/727,761 which was filed on Sep. 6, 2018.

FIELD OF THE INVENTION

This invention relates generally to a side cutter assembly that may be attached to a conventional milling machine, and to a method for modifying a conventional milling machine to install a side cutter assembly. More specifically, the invention comprises a side cutter assembly that is removably attached to a conventional milling machine, as well as a storage skid for the primary components of the side cutter assembly.

BACKGROUND AND DESCRIPTION OF THE PRIOR ART

Roadway repair is often accomplished by overlaying the existing pavement (whether of concrete or asphalt paving material) with a new layer (often called a leveling course) of concrete or asphalt paving material. Without prior surface treatment, however, this method of repair generally results in the application of insufficient quantities of paving material in the rutted, potholed or otherwise damaged areas, because the overlay will be applied at the same rate per unit of roadway width in damaged areas (which have a greater depth to be filled across the width) as in the undamaged areas. The resulting reduced thickness in the overlay of the previously damaged areas will lead to renewed rutting or other wear damage in the new pavement in relatively short order. However, by milling the surface of the damaged pavement to a uniform surface elevation below the level of the damage, the addition of new pavement will produce a road surface having a consistent elevation across the entire width of the roadway. This repaving technique can be used to return the elevation of a damaged roadway to its original pre-damaged elevation, whereas the placement of a leveling course atop damaged but un-milled pavement will tend to raise the surface of the roadway or some portion thereof above its original elevation. Roadway repair without milling can require the raising of road shoulders, guardrails and manhole covers and the adjustment of overpass clearances, all of which is unnecessary if a proper milling technique is employed. A use of milling prior to repaving can also permit ready establishment of the proper road grade and slope, and thereby avoid drainage and safety problems. Furthermore, milling typically provides a rough surface that readily accepts and bonds with the new asphalt or other pavement overlay. Finally, milling can provide raw material that can be reclaimed for use in the production of new paving materials.

A milling machine typically comprises a wheeled or track-driven vehicle that includes a milling drum having a plurality of cutting teeth disposed around its periphery, which milling drum is mounted for rotation about a substantially-horizontal axis within a drum housing on the frame of the machine. Steerable wheel-drive or track-drive assemblies operated by hydraulic motors are provided to drive the machine in a milling direction and to steer it along a desired milling path. The drive assemblies are attached to lifting columns that include internal linear actuators which can be activated to raise and lower the frame of the machine with respect to the roadway surface. Wheel-drive machines include four ground-engaging wheel-drive assemblies, one at the left front, one at the right front, one at the left rear and one at the right rear. Track-drive machines include three or four ground-engaging track-drive assemblies including one at the left front and one at the right front. Some such machines will also include a third track-drive assembly at the left rear and a fourth at the right rear; however, some track-drive machines will have only a single, center-mounted rear drive assembly.

Since the milling drum is mounted for rotation in a housing on the frame of the machine, raising the frame on the lifting columns can raise the milling drum out of contact with the roadway surface, and lowering the frame on the lifting columns can lower the milling drum into contact with the road surface so as to make a cut of the desired depth. The milling drum is rotated by a primary drum drive assembly typically comprising a drive belt driven by a diesel engine, which drive belt engages a drivetrain comprising a sheave on an input drive shaft for the milling drum. A gear box is typically located between the sheave and the milling drum and includes a gear train and an output drive shaft on which the milling drum is rotated. The gear box thus allows for rotation of the output drive shaft for the milling drum at a speed and torque that is different from that of the input drive shaft. A milling machine may include a conveyor system that is designed to carry the milled material that has been cut from the roadway by the rotating milling drum to a location in front of, to the rear of, or beside the machine for deposit into a truck for removal from the milling site. Power for operation of the hydraulic motors that are typically employed to operate the conveyors and the drive assemblies is usually provided by the diesel engine.

It is sometimes necessary to remove the shoulder of an existing roadway for repaving or widening of the paved portion of the roadway. Since the milling drum of a conventional milling machine lies entirely within the width of the machine, positioning such a machine so as to mill the shoulder of the roadway would require the drive assemblies on one side of the machine to travel on a surface outside the roadway shoulder. Often, a ditch, sloped surface, fence, guardrail or other barrier lies outside the shoulder, so that it is extremely difficult or impossible to use a conventional milling machine to mill or remove a roadway shoulder. Consequently, it would be advantageous to provide a milling machine with a side cutter milling drum that is offset to the side of the milling machine, i.e., one that extends outside the drive assemblies on one side of the machine. It would also be advantageous to provide such a machine with a side cutter primary conveyor to convey material cut by the side cutter milling drum out of the side cutter drum housing. It would also be desirable, in some circumstances, to configure the side cutter primary conveyor to convey material from the side cutter drum housing to a secondary conveyor for delivery of the material either to a dump truck traveling in front of or behind the milling machine or to the ground outside the path of the milling machine. It would also be desirable if the side cutter milling assembly could be mounted to a conventional milling machine without requiring substantial modifications to be made to the milling machine.

Advantages of a Preferred Embodiment of the Invention

Among the advantages of a preferred embodiment of the invention is that it provides a milling machine with a side cutter milling drum that is offset to the side of the milling machine, i.e., one that extends outside the drive assemblies on one side of the machine. Another advantage of a preferred embodiment of the invention is that it provides such a machine with a side cutter primary conveyor to convey material cut by the side cutter milling drum out of a side cutter drum housing to a secondary conveyor for delivery of the material either to a dump truck traveling in front of or behind the milling machine or to the ground outside the path of the milling machine. Another advantage of a preferred embodiment of the invention is that it provides a removable side cutter milling assembly that can be mounted to a conventional milling machine without requiring substantial modifications to the milling machine. Additional objects and advantages of this invention will become apparent from an examination of the drawings and the ensuing description.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "attached", "connected" and "interconnected", refer to a relationship wherein structures are secured or attached to one another either directly or indirectly through intervening structures, as well as both moveable and rigid attachments or relationships, unless otherwise described herein either specifically or as indicated by context. The terms "operatively attached" and "operatively connected" are such attachments, couplings or connections that allow the pertinent structures to operate as intended by virtue of that relationship.

The use of any and all examples or exemplary language (e.g., "such as" and "preferably") herein is intended merely to better illuminate the invention and the preferred embodiment thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

The term "milling machine" refers to a vehicle having a milling drum that is adapted to be rotated so as to cut into the surface on which the vehicle is operated.

The term "milling direction" refers to the direction of travel of a milling machine as it operates to mill the surface of a roadway.

The terms "front", "forward" and similar terms, when used with respect to a milling machine or a component of such a machine, refer to a relative location or direction towards the leading end of the milling machine as it travels in the milling direction.

The terms "rear", "behind" and similar terms, when used with respect to a milling machine or a component of such a machine, refer to a relative location or direction towards the trailing end of the milling machine as it travels in the milling direction.

The terms "upper", "top", "above" and similar terms, when used in reference to a relative position or direction on or with respect to a milling machine, or a component or portion of such a machine, refer to a relative position or direction that is farther away from the surface on which the milling machine is placed for operation.

The terms "lower", "bottom", "below" and similar terms, when used in reference to a relative position or direction on or with respect to a milling machine, or a component or portion of such a machine, refer to a relative position or direction that is nearer to the surface on which the milling machine is placed for operation.

The term "left", as used herein to describe a direction or relative position of a milling machine or an assembly, component or portion of such a machine, refers to a position or orientation towards the left, from the perspective of the operator who is driving the machine in the milling direction while facing forward.

The term "right", as used herein to describe a direction or relative position of a milling machine or an assembly, component or portion of such a machine, refers to a position or orientation towards the right, from the perspective of the operator who is driving the machine in the milling direction while facing forward.

The terms "linear actuator" and "actuator" refer to an electric, pneumatic, hydraulic, electro-hydraulic or mechanical device that generates force which is directed in a straight line. One common example of a "linear actuator" is a hydraulic actuator which includes a cylinder, a piston within the cylinder, and a rod attached to the piston. By increasing the pressure within the cylinder on one side of the piston (over that on the opposite side of the piston), the rod will extend from the cylinder or retract into the cylinder.

SUMMARY OF THE INVENTION

The invention comprises a side cutter milling assembly for a milling machine that includes a side cutter milling drum and a side cutter drum housing that attaches to the frame of a conventional milling machine without requiring substantial modification to the milling machine. The side cutter milling drum is offset to one side of the milling machine. In a preferred embodiment of the invention, the side cutter milling assembly includes a side cutter primary conveyor to convey material cut by the side cutter milling drum out of the side cutter drum housing.

The side cutter milling assembly is adapted for use in modifying a milling machine having a frame, a milling drum housing that is removably attached to the frame, a milling drum that is mounted for rotation within the milling drum housing, and a primary drum drive assembly that is adapted to rotate the milling drum. The side cutter milling assembly comprises a drum housing having a main portion which is adapted to be installed on the frame of the milling machine in place of the milling drum housing, and a side portion that is offset to one side of the milling machine. The side cutter milling assembly also includes a side cutter milling drum that is mounted for rotation within the side portion of the drum housing, and a side cutter drivetrain that is adapted to be operatively attached to the side cutter milling drum and the primary drum drive assembly. A preferred embodiment of the invention includes a side cutter primary conveyor that is adapted to convey material milled by the side cutter milling drum to a secondary conveyor for delivery of the material either to a dump truck traveling in front of or behind the milling machine or to the ground outside the path of the milling machine.

In order to facilitate an understanding of the invention, the preferred embodiments of the invention, as well as the best mode known by the inventor for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventor includes all equivalents of the subject matter described herein, as well as various modifications and alternative embodiments such as would ordinarily occur to one skilled in the art to which the invention relates. The inventor expects skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiment of the invention is illustrated in the accompanying drawings, in which like reference numerals represent like parts throughout, and wherein.

DESCRIPTION OF THE PREFERRED EMBODIMENTS OF THE INVENTION

Figure 1:
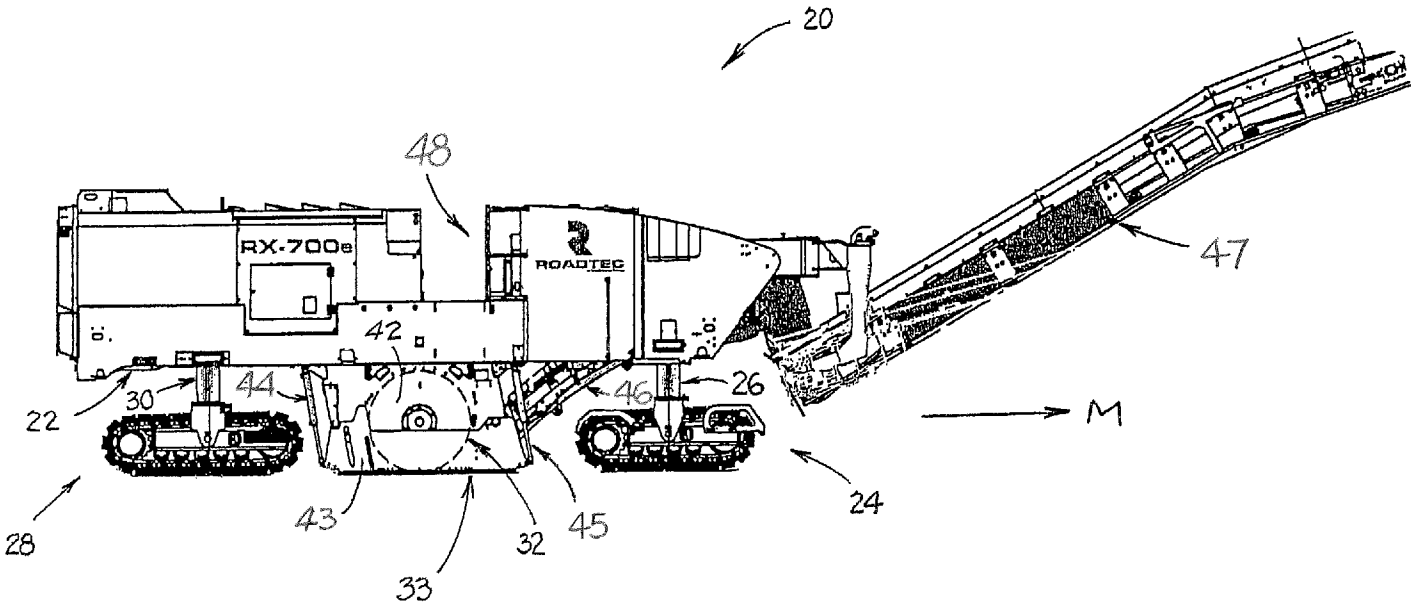
FIGURE 1 (Prior Art)
FIG. 1 is side view of a conventional milling machine to which the invention may be attached.

This description of preferred embodiments of the invention is intended to be read in connection with the accompanying drawings, which are to be considered part of the entire written description of this invention. The drawing figures are not necessarily to scale, and certain features of the invention may be shown exaggerated in scale or in somewhat schematic form in the interest of clarity and conciseness.

Figure 2:
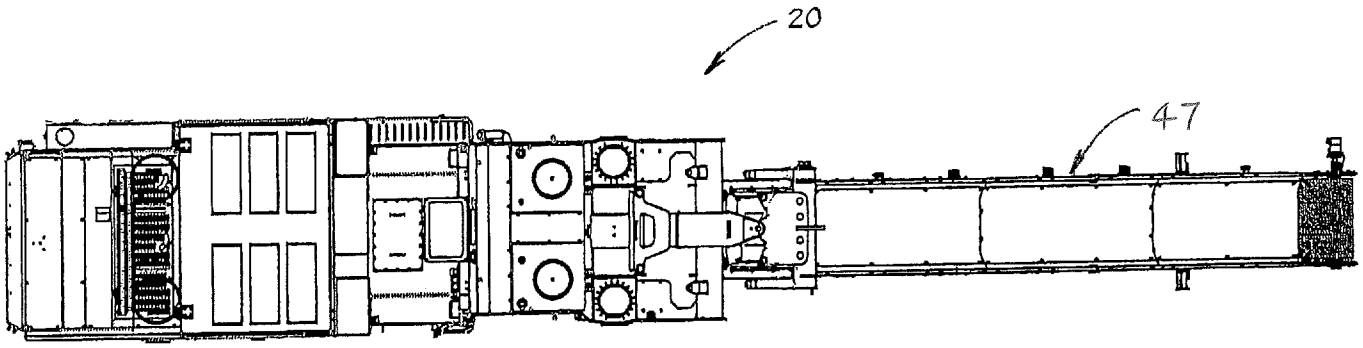
FIGURE 2 (Prior Art)
FIG. 2 is a top view of the milling machine shown in FIG. 1.

As shown in FIGS. 1 and 2, a conventional milling machine that may be modified according to the invention is indicated generally at 20. This machine comprises a mobile vehicle having a frame 22 and a plurality of ground-engaging drive assemblies, including right front track drive assembly 24, which includes lifting column 26, a left front track drive assembly (not shown but substantially similar to right front track drive assembly 24), right rear track drive assembly 28, which includes lifting column 30, and a left rear track drive assembly (not shown but substantially similar to right rear track drive assembly 28). As is known to those having ordinary skill in the art to which the invention relates, the milling machine may alternatively include four ground-engaging wheel-drive assemblies, or left and right front track drive assemblies and a single center-mounted rear track drive assembly.

Figure 3:
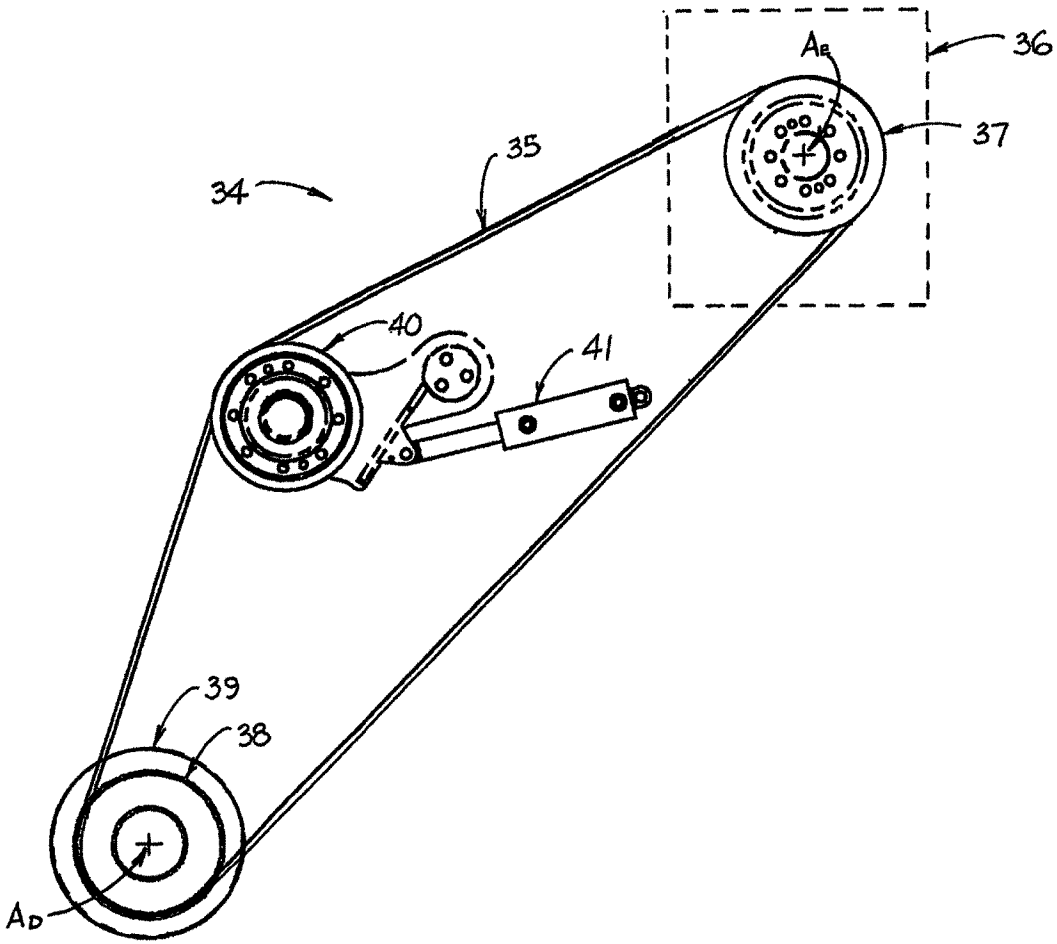
FIGURE 3 (Prior Art)
FIG. 3 is a front view of certain components of the primary drive assembly for the milling drum of the milling machine illustrated in FIGS. 1 and 2.

A linear actuator (not shown) is mounted within each of the lifting columns of the ground-engaging drive assemblies. These linear actuators are adapted to raise and lower the frame of the milling machine with respect to the surface being milled. Preferably, the front drive assemblies are steerable to provide precise directional control. The drive assemblies of machine 20 are driven by a machine drive system including an engine (not shown in FIGS. 1 and 2), a plurality of hydraulic motors and a hydraulic fluid circuit (not shown) to advance the machine across the surface of a roadway, parking lot or other surface to be milled in the milling direction indicated by arrow "M". Milling machine 20 also includes a conventional milling assembly comprising a generally cylindrical milling drum 32 having a plurality of cutting teeth (not shown) disposed around its periphery. The milling drum is mounted for rotation on the frame of milling machine 20 within milling drum housing 33 by the operation of primary drum drive assembly 34 (shown in FIG. 3). This primary drum drive assembly includes drive belt 35 that is operatively attached to and is driven by an engine drive shaft (not shown, but indicated by and adapted to rotate about engine drive shaft axis $A_E$) of diesel engine 36 (shown schematically in FIG. 3), on which engine drive sheave 37 is mounted. Drive belt 35 is also operatively attached to drum sheave 38 on an input drive shaft (indicated by and adapted to rotate about input drum drive shaft axis $A_D$) for milling drum 32. In other embodiments of the invention (not shown), the primary drum drive assembly comprises one or more hydraulic motors (not shown) and a drive belt that engages a sheave on an input shaft for the milling drum.

Gear box 39 is located between drum sheave 38 and the milling drum (not shown in FIG. 3) in both the primary drum drive assembly comprising a direct engine drive shown in the drawings, and in a primary drum drive assembly that includes one or more hydraulic motors. Gear box 39 includes a gear train and an output drive shaft on which the milling drum is rotated. The gear box thus allows for rotation of the output drive shaft for the milling drum at a speed and torque that is different from that of the input drum drive shaft. Primary drum drive assembly 34 also includes a belt tensioning assembly including tensioning sheave 40, which is pivotally mounted within the primary drum drive assembly, and tensioning actuator 41 that is operatively attached to the tensioning sheave. Tensioning actuator 41 is a linear actuator that may be employed to move tensioning sheave 40 in order to increase or decrease the tension of drive belt 35.

As is conventional, it is preferred that milling drum housing 33 include bolt holes (not shown) that are adapted to be aligned with similar bolt holes in frame 22 (also not shown) so that bolts can be used to removably attach the milling drum housing to the frame. As shown in FIG. 1, milling drum housing 33 includes upper right side plate 42 and lower right side plate 43. Upper right side plate 42 is fixed to frame 22, and lower right side plate 43 is adapted to move upwardly and downwardly with respect to the upper right side plate by the action of linear actuators 44 and 45.

Milling drum housing 33 also includes side plates that are substantially similar to upper right side plate 42 and lower right side plate 43 on the left side of the machine.

Milling drum 32 extends substantially across the width of milling machine 20 within milling drum housing 33 and is contained within the sidewalls of milling machine 20, so that milling drum 32 does not extend outside the drive assemblies. Milling drum 32 is adapted for cutting a width of material from the surface in the path of the machine, and depositing the milled material onto first conveyor 46, which carries it to second conveyor 47 for discharge into a truck. Milling machine 20 is operated by an operator in operator's station 48.

Figure 4:
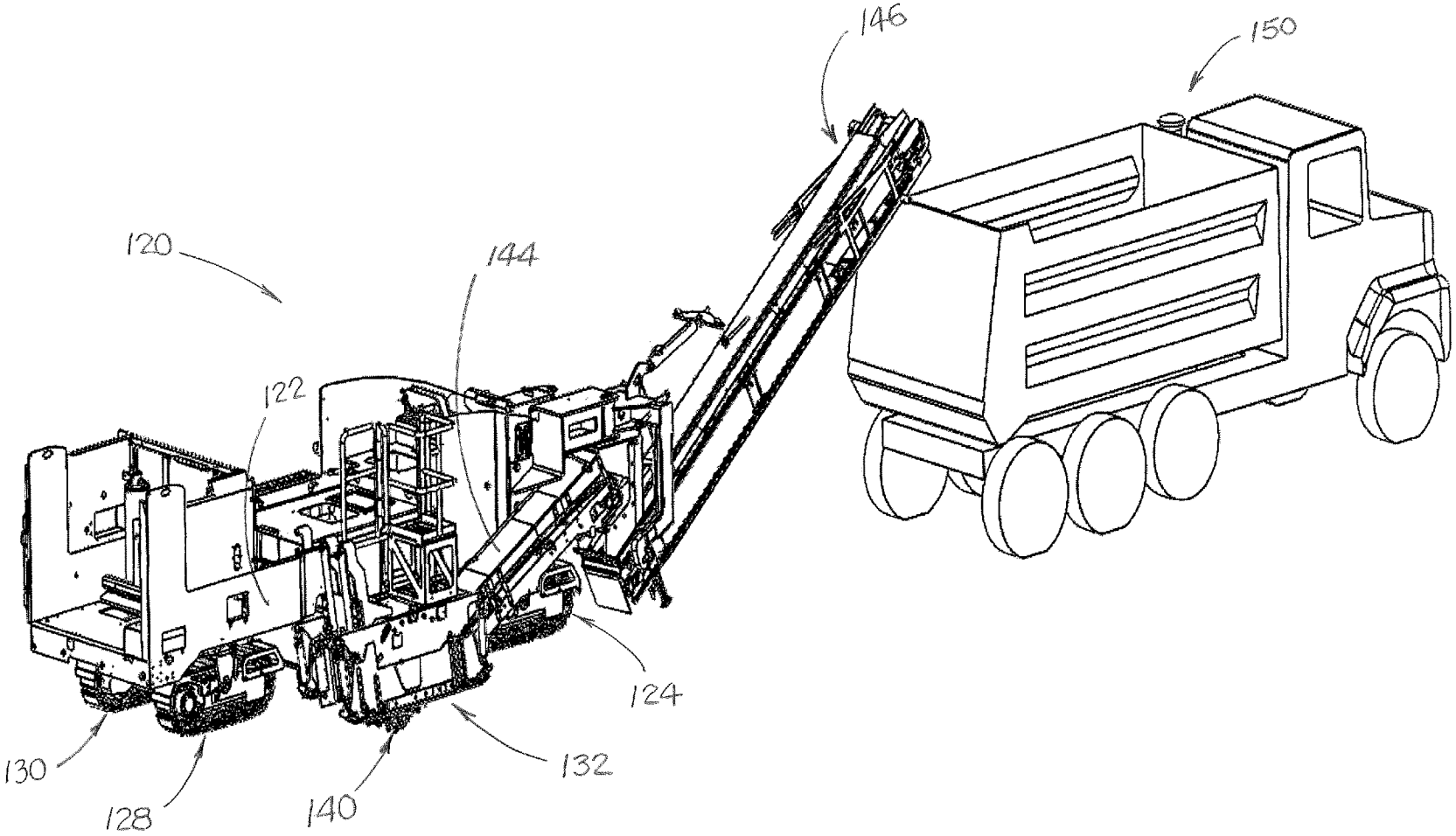
FIG. 4 is a perspective view of a milling machine similar that that shown in FIGS. 1 and 2, but modified by the invention, in cooperation with a dump truck.
Figure 5:
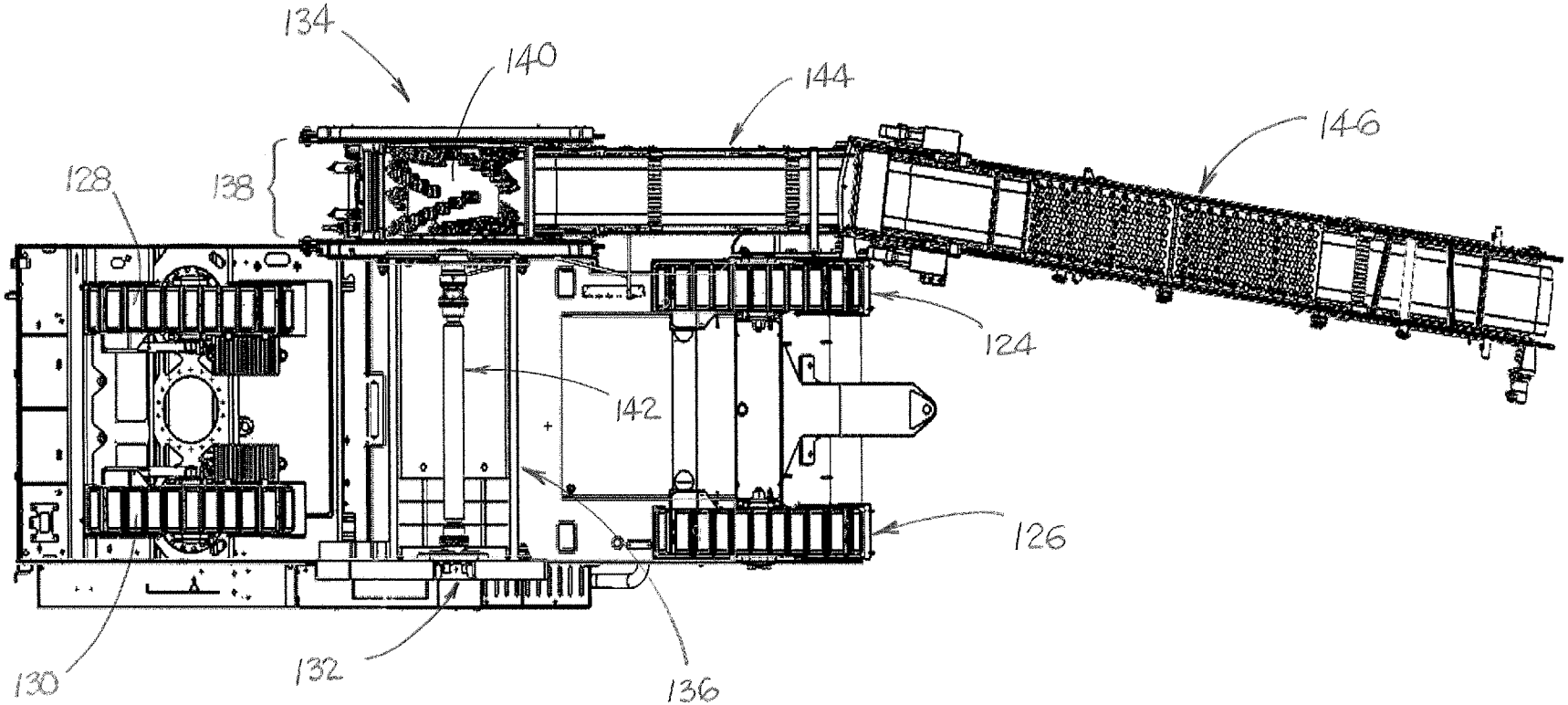
FIG. 5 is a bottom view of the modified milling machine shown in FIG. 4.
Figure 6:
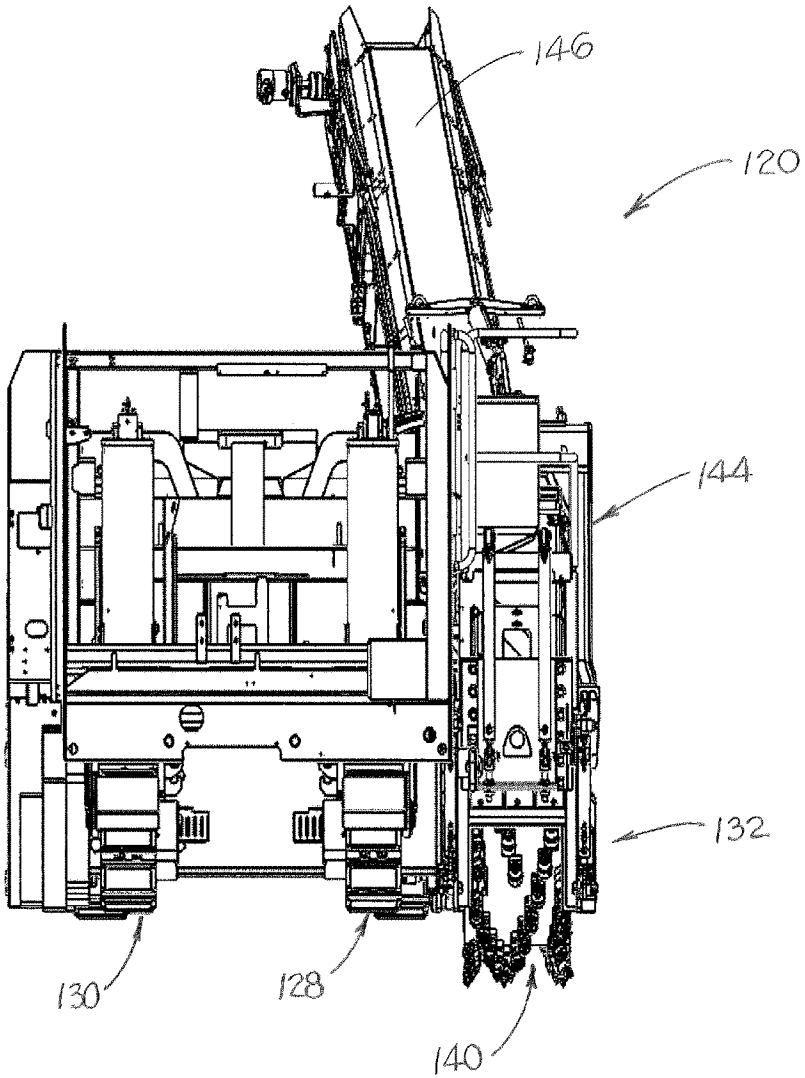
FIG. 6 is an end view of the modified milling machine shown in FIGS. 4 and 5.
Figure 7:
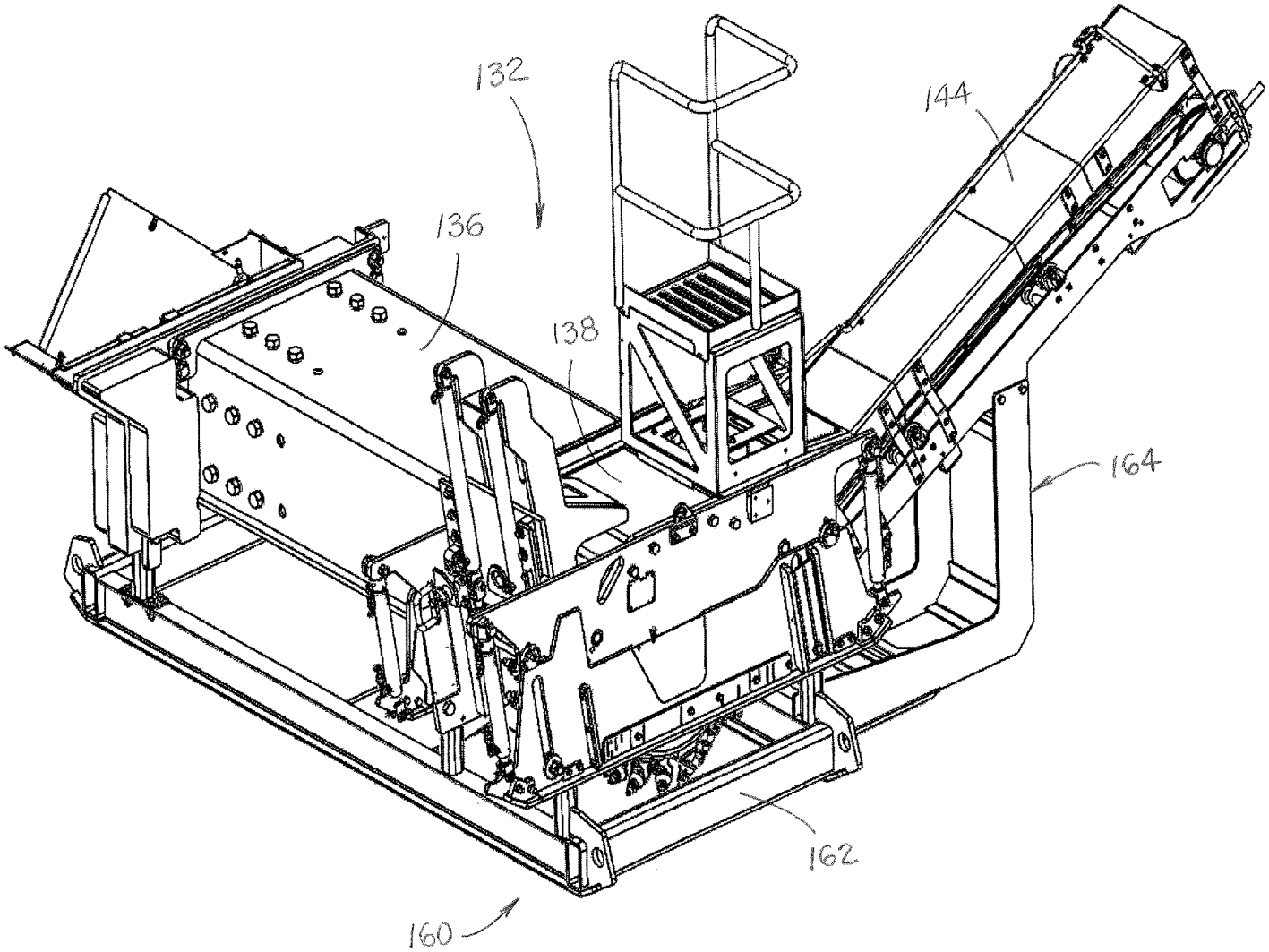
FIG. 7 is a perspective view of a storage component for the removable side cutter assembly of a preferred embodiment of the invention.

As shown in FIGS. 4-6, modified milling machine 120 comprises a mobile vehicle having a frame 122 and a plurality of ground-engaging drive assemblies, including right front track drive assembly 124, left front track drive assembly 126, right rear track drive assembly 128 and left rear track drive assembly 130. Each of the track drive assemblies includes a lifting column having an internal linear actuator that is adapted to raise and lower the frame of the milling machine with respect to the surface being milled.

Milling machine 120 also includes side cutter milling assembly 132 comprising drum housing 134, which includes main portion 136, and side portion 138 that is offset to one side of the milling machine. Main portion 136 of drum housing 134 is installed in place of a conventional drum housing (such as drum housing 33 of milling machine 20), preferably by inserting the same bolts that were used to mount a conventional but removable milling drum housing (such as milling drum housing 33) into holes in main portion 136 that are aligned with holes in frame 122.

Thus, milling machine 120 comprises a modified version of milling machine 20 that is obtained, in part, by removing drum housing 33 and replacing it with drum housing 134. When so modified, main portion 136 of drum housing 134 is contained within the sidewalls of milling machine 120, and side portion 138 of drum housing 134 extends outside the drive assemblies on one side of the machine. For machines intended for use in the United States, the side portion of the drum housing preferably extends outside the drive assemblies on the right side of the machine, as shown in FIGS. 4-6.

Milling assembly 132 also includes side cutter milling drum 140, and side cutter drivetrain 142 that is adapted to be operatively attached to the side cutter milling drum and the primary drum drive assembly (not shown, but substantially similar to primary drum drive assembly 34) of milling machine 120. Thus, side cutter drivetrain 142 comprises a drive shaft and suitable bearings for mounting the drive shaft across the width of milling machine 120 within main portion 136 of drum housing 134, as shown in FIG. 5. Attached to this drive shaft is a side cutter drum sheave (not shown, but substantially similar to drum sheave 38), and optionally a side cutter gear box (also not shown, but substantially similar to gear box 39). The side cutter drum sheave is driven by a drive belt (not shown, but substantially similar to drive belt 35) by a diesel engine (also not shown, but substantially similar to engine 36) that is a part of the conventional primary drum drive assembly for the milling machine. Side cutter drive train 142 is thus operatively attached to the side cutter milling drum and the conventional drum drive assembly for the milling machine on the side of the milling machine opposite side cutter milling drum 140 (i.e., the left side of milling machine 120). Side cutter drivetrain 142 is thereby adapted to transfer rotational motion from the engine drive sheave (not shown, but substantially similar to engine drive sheave 37) of the primary drum drive assembly to side cutter milling drum 140.

Side cutter milling drum 140 comprises a generally cylindrical milling drum having a plurality of cutting teeth disposed around its periphery. Consequently, it is very similar (except for length) to a conventional milling drum such as milling drum 32 of milling machine 20.

In the preferred embodiment of the invention shown in the drawings, side cutter primary conveyor 144 is attached to side portion 138 of drum housing 134 and is adapted to convey material milled by side cutter milling drum 140 away from side cutter milling drum 140. Preferably, side cutter primary conveyor 144 carries milled material to side cutter secondary conveyor 146 for delivery of the material either to a dump truck (such as truck 150) traveling in front of or behind the milling machine or for deposit on the ground outside the path of the milling machine. Side cutter primary conveyor 144 and side cutter secondary conveyor 146 are preferably operated by hydraulic motors (not shown) that are operatively attached to the hydraulic circuit of milling machine 120 by means known to those having ordinary skill in the art to which the invention relates. Side cutter primary conveyor 144 and side cutter secondary conveyor 146 are arranged and configured similarly to first conveyor 46 and second conveyor 47, respectively, of milling machine 20.

When side cutter milling assembly 132 is not attached to a milling machine, drum housing 134, side cutter drum 140 and side cutter primary conveyor 144 may be stored on storage skid 160, which includes base portion 162 for supporting the drum housing and the side cutter drum, and upstanding conveyor support portion 164 for supporting the side cutter primary conveyor. Side cutter secondary conveyor 146 may be stored separately. Storage skid 160 may be easily transported to a milling site where it is desired to modify a conventional milling machine to include side cutter milling assembly 132.

Although this description contains many specifics, these should not be construed as limiting the scope of the invention but as merely providing an illustration of the presently preferred embodiments thereof, as well as the best mode contemplated by the inventors of carrying out the invention. The invention, as described herein, is susceptible to various modifications and adaptations as would be appreciated by those having ordinary skill in the art to which the invention relates.

What is claimed is:

1. A side cutter milling assembly for a milling machine having a frame, a milling drum housing that is removably attached to the frame, a milling drum that is mounted for rotation within the milling drum housing, and a primary drum drive assembly that is adapted to rotate the milling drum, said side cutter milling assembly comprising:

(a) a drum housing comprising:
  (i) a main portion which is adapted to be installed on the frame of the milling machine in place of the milling drum housing;
  (ii) a side portion that is offset to one side of the milling machine;
(b) a side cutter milling drum that is mounted for rotation within the side portion of the drum housing;
(c) a side cutter drivetrain that is adapted to be operatively attached to the side cutter milling drum and the primary drum drive assembly.

2. The side cutter milling assembly of claim 1 comprising a side cutter primary conveyor which is adapted to convey material milled by the side cutter milling drum.

3. The side cutter milling assembly of claim 2:

(a) which includes a side cutter secondary conveyor;

(b) wherein the side cutter primary conveyor is configured to convey material milled by the side cutter milling drum to the side cutter secondary conveyor.

4. The side cutter milling assembly of claim 2 which includes a storage skid comprising:

(a) a base portion for supporting the drum housing and the side cutter milling drum;

(b) an upstanding conveyor support portion for supporting the side cutter primary conveyor.

5. The side cutter milling assembly of claim 1 wherein the side cutter drivetrain is adapted to be operatively attached to the primary drum drive assembly on the opposite side of the milling machine from the side portion of the drum housing.

6. The side cutter milling assembly of claim 5 wherein the side cutter drivetrain includes a drive shaft and suitable bearings for mounting the drive shaft across the width of the milling machine within the main portion of the drum housing.

7. The side cutter milling assembly of claim 1 wherein:

(a) the frame and the milling drum housing include bolt holes that are adapted to be aligned so that bolts can be used to removably attach the milling drum housing to the frame;

(b) the main portion of the drum housing is adapted to be bolted to the frame using the same bolts and bolt holes as are used to mount the milling drum housing to the frame.

8. A method for modifying a milling machine having a frame, a milling drum housing that is removably attached to the frame, a milling drum that is mounted for rotation within the milling drum housing, and a primary drum drive assembly that is adapted to rotate the milling drum, said method comprising:

(a) removing the milling drum housing and the milling drum from the milling machine;

(b) replacing the milling drum housing with a drum housing of a side cutter milling assembly, said drum housing comprising:

(i) a main portion which is adapted to be installed on the frame of the milling machine in place of the milling drum housing;

(ii) a side portion that is offset to one side of the milling machine;

(c) mounting a side cutter milling drum of the side cutter milling assembly within the side portion of the drum housing;

(d) installing a side cutter drivetrain of the side cutter milling assembly across the width of the milling machine within the main portion of the drum housing of the side cutter milling assembly;

(e) operatively attaching the side cutter drivetrain to the side cutter milling drum and the primary drum drive assembly;

(f) installing a side cutter primary conveyor of the side cutter milling assembly so that said side cutter primary conveyor is configured and adapted to convey material milled by the side cutter milling drum.

* * * * *